United States Patent [19]

Ishizaki et al.

[11] 4,203,729

[45] May 20, 1980

[54] METHOD FOR PRODUCING COAL DISPERSING OIL COMPOSITIONS

[75] Inventors: Takaharu Ishizaki; Taizo Igarashi; Hirozumi Shimizu, all of Amagasaki, Japan

[73] Assignee: Nippon Oil & Fats Co. Ltd., Tokyo, Japan

[21] Appl. No.: 919,048

[22] Filed: Jun. 26, 1978

[30] Foreign Application Priority Data

Jun. 30, 1977 [JP] Japan ..... 52-77166

[51] Int. Cl.[2] ..... C10L 1/32

[52] U.S. Cl. ..... 44/51

[58] Field of Search ..... 44/51, 1 G

[56] References Cited

U.S. PATENT DOCUMENTS

| | | | |
|---|---|---|---|
| 1,390,232 | 9/1921 | Bates | 44/51 |
| 2,430,085 | 11/1947 | Spencer et al. | 44/51 |
| 3,210,168 | 10/1965 | Morway | 44/51 |
| 3,617,095 | 11/1971 | Lissant | 44/51 |

FOREIGN PATENT DOCUMENTS

| | | |
|---|---|---|
| 50-37178 | 4/1975 | Japan . |
| 51-66302 | 6/1976 | Japan . |

*Primary Examiner*—Delbert E. Gantz
*Assistant Examiner*—Y. Harris-Smith
*Attorney, Agent, or Firm*—Stevens, Davis, Miller & Mosher

[57] ABSTRACT

Coal dispersing oil compositions containing 10–89.99% by weight of a petroleum oil, 10–89.99% by weight of coal powders and 0.01 to 5% by weight of a surface active agent are produced by mixing previously milled coal powders and a petroleum oil and then dehydrating, or by millng and dehydrating coal in the petroleum oil, and then adding a surface active agent thereto to obtain dispersion.

4 Claims, No Drawings

METHOD FOR PRODUCING COAL DISPERSING OIL COMPOSITIONS

The present invention relates to a coal dispersing oil wherein coal powders are dispersed in a petroleum oil.

The energy source which until now has been chiefly used is petroleum, but the amount of petroleum in reserve is limited and the amount consumed is large, so that there is fear that petroleum will soon be exhausted. Accordingly, the attempt to effectively utilize coal, which is abundantly present in the world has been actively made, and the study regarding gasfication and liquefaction of coal has been ardently pursued, but a long period of time will be necessary for the use of such techniques becomes practical.

On the other hand, as a technique capable of being practically used in the near future, coal dispersing oil, wherein coal and petroleum are mixed, is of interest. Coal dispersing oil is a fuel in which coal powders and a petroleum oil are mixed and water and a surface active agent are added thereto to form a homogeneous dispersion that keeps for a long time. This coal dispersing oil can be handled and burned in the same manner as normal liquid fuel and is considered to be of likely usefulness in the future for a furnace of a power plant and a large size boiler, wherein a large amount of petroleum is burned, because petroleum would thereby be saved.

However, it is essential for the coal dispersing oils heretofore mentioned to add water to coal powders, and mix petroleum oil and a surface active agent therewith to form a gelation or thixotropic emulsion (U.S. Pat. No. 3,617,095, U.S. Pat. No. 3,210,168, U.S. patent application Ser. No. 518,509). It is said that this is effective for decreasing nitrogen oxide in the exhaust gas, but since a fairly large amount of water is contained therein, this is disadvantageous with respect to combustion efficiency or the difficulty of transporting large amounts thereof, and furthermore when a shear stress is applied, the emulsion is broken.

It has been found that when water is not added, coal powders are easily and stably dispersed in a petroleum oil, but when a strongly combined water is contained therein as in sub-bitumious coal, brown coal and lignite, the stable coal dispersing oil composition can not be obtained.

This is because even if these coals are dried to the state where dry pulverizing can be effected, it is impossible to remove the combined water completely and the combined water comes out gradually into the system of the coal dispersing oil, and the stability is broken. When the coal powders are dried in air in order to completely remove the combined water, there is danger of ignition.

The inventors have diligently studied this matter, and have found a method for producing coal dispersing oil stable for a long period of time from the coals having such combined water.

The method of the present invention comprises mixing previously milled coal powders with a petroleum oil and then heating the mixture to effect dehydration, or milling and dehydrating coal in a petroleum oil, after which a surface active agent is added thereto and the mixture is thoroughly stirred to obtain dispersion. In this process, the stage of addition of the surface active agent is important, and when the surface active agent is present when dehydrating or milling, the stable coal dispersing oil can not be obtained.

For the dehydration of coal powders it is merely necessary to heat the powders in petroleum oil at a temperature of 100°-150° C. In order to effect milling and dehydrating of coal concurrently, the milling is effected by means of a wet mill by heating at a temperature of 100°-150° C. When the dehydration is effected in petroleum oil, there is no danger of ignition.

For obtaining the stable cool dispersing oil compositions, it is necessary that in the dehydrating step, the water content in the composition is less than about 3% by weight, preferably less than 2% by weight.

The particle size is preferred to be 1-100μ.

For stirring and mixing upon obtaining the coal dispersing oil, it is preferable to use a colloid mill or a homogenizer.

The coals to be used herein are sub-bituminous coal, brown coal and lignite having the combined water.

The petroleum oil to be used in the present invention must not contain the component which volatilizes by heating upon dehydration, and from this viewpoint fuel oil is the particularly preferable petroleum oil.

As the surface active agents, use may be made of quaternary ammonium salts of cationic surface active agents, phosphates, sulfonates, sulfates, fatty acid salts and the like of anionic surface active agents. In particular, the following anionic surface active agents are preferable.

(a) Phosphates

Alkyl phosphates, such as n-octyl phosphate, 2-ethylhexyl phosphate, n-decyl phosphate, lauryl phosphate, myristyl phosphate, cetyl phosphate, stearyl phosphate, oleyl phosphate; alkylphenyl phosphates, such as octylphenyl phosphate, nonylphenyl phosphate; polyoxyalkylene alkyl ether phosphate, such as phosphoric esters of addition products of ethylene oxide or propylene oxide and n-octyl alcohol, 2-ethylhexyl alcohol, n-decyl alcohol, lauryl alcohol, myristyl alcohol, cetyl alcohol, stearyl alcohol, oleyl alcohol and the like; polyoxyalkylene alkylphenyl ether phosphates, such as phosphoric esters of addition products of octyl phenol or nonyl phenol and ethylene oxide or propylene oxide are preferable and monosubstituted phosphoric esters and disubstituted phosphoric esters are particularly preferable. In addition, metal salts and amine salts of these compounds are used and as the metal salts, mention may be made of salts of lithinum, sodium, potassium, magnesium, calcium, barium, aluminum, zinc, iron and the like, and as amine salts mention may be made of salts of ammonium, methylamine, ethylamine, butylamine, laurylamine, stearylamine, oleylamine, dimethylamine, diethylamine, ethylenediamine, diethylenetriamine, monoethanolamine, diethanolamine, triethanolamine, morpholine, aniline, benzylamine and the like.

(b) Sulfonates

Dialkyl sulfosuccinates, such as di-n-hexyl sulfosuccinate, di-n-octyl sulfosuccinate, di-2-ethylhexyl sulfosuccinate, di-n-decyl sulfosuccinate, n-hexyl-n-octyl sulfosuccinate, n-hexyl-n-decyl sulfosuccinate and the like; dialkenyl sulfosuccinates, such as dioleyl sulfosuccinate, dilinoleyl sulfosuccinate and the like; alkane sulfonic acids, such as dodecanesulfonic acid, tetradecane sulfonic acid, hexadecane sulfonic acid, octadecane sulfonic acid and the like; olefinsulfonic acids, such as dodecane sulfonic acid, tetradecane sulfonic acid, octadecane sulfonic acid and the like; α-sulfonated fatty acids, such as α-sulfolauric aid, α-sulfomyristic acid, α-sulfopalmitic acid, α-sulfostearic acid and the like; α-sulfonated fatty acid alkyl esters, such as methyl esters, ethyl esters, isopropyl esters, n-butyl esters, isobutyl esters, 2-ethylhexyl esters of the above described α-sulfonated fatty acids; alkylbenzene sulfonic acids, such as nonylbenzene sulfonic acid, dodecylbenzene sulfonic acid and the like; alkylpnenol sulfonic acids, such as octylphenol sulfonic acid, nonylphenol sulfonic acid, dodecylphenol sulfonic acid and the like, and further naphthalene sulfonic acid and petroleum sulfonic acid are used.

Furthermore, metal salts and amine salts of these compounds can be used, and as the metal salts, mention may be made of lithium, sodium, potassium, magnesium, calcium, barium, aluminum, zinc and iron salts and the like, and as the amine salts, mention may be made of ammonium, methylamine, ethylamine, butylamine, laurylamine, stearylamine, oleylamine, dimethylamine, diethylamine, ethylenediamine, diethylenetriamine, monoethanolamine, diethanolamine, triethanolamine, morpholine, aniline, benzylamine salts and the like.

(c) Sulfates

Alkyl sulfates, such as n-octyl sulfate, 2-ethylhexyl sulfate, n-decyl sulfate, lauryl sulfate, myristil sulfate, cetyl sulfate, stearyl sulfate and the like; polyoxyalkylene alkylphenyl ether sulfates, such as sulfates of addition products of ethylene oxide or propylene oxide and n-octyl alcohol, 2-ethylhexyl alcohol, n-decyl alcohol, lauryl alcohol, myristyl alcohol, cetyl alcohol, stearyl alcohol, oleyl alcohol and the like; polyoxyalkylene alkylphenyl ether sulfates, such as sulfates of addition products of ethylene oxide or propylene oxide and octyl phenol, nonyl phenol, dodecyl phenol and the like; polyoxyalkylene fatty acid ester sulfates, such as sulfates of addition products of ethylene oxide or propylene oxide and lauric acid, myristic acid, palmitic acid, stearic acid, oleic acid and the like; sulfated fatty oils, such as sulfates of sperm oil, tallow, tall oil and the like. In addition, metal salts and amine salts of these compounds are used, and as the metal salts, mention may be made of salts of lithium, sodium, potassium, magnesium, calcium, barium, aluminum, zinc, iron and the like, and as amine salts mention may be made of salts of ammonium, methylamine, ethylamine, butylamine, laurylamine, stearylamine, oleylamine, dimethylamine, diethylamine, ethylenediamine, diethylenetriamine, monoethanolamine, diethanolamine, triethanolamine, morpholine, aniline, benzylamine and the like.

These surface active agents may be used in the form of a mixture of two or more compounds.

The composition of the coal dispersing oil composition according to the present invention consists of 10–89.99% by weight of petroleum oil, 10–89.99% by weight of coal powders and 0.01–5% by weight of a surface active agent. The amount of coal powders in this composition shows the amount of the anhydrous state, wherein the combined water is removed.

The coal dispersing oil compositions obtained by the production method of the present invention are stable for more than 60 days and have sufficient stability for practical use. Furthermore even if a shear stress is applied, the coal dispersing oil compositions are stable.

The invention will be explained in detail by the following example, which is not limitative of the invention.

EXAMPLE

As the coals, use was made of sub-bituminous coal (water content: 20%) produced from Indonesia, brown coal (water content: 20%) produced from Indonesia and lignite (water content: 30%) produced from Japan and as the petroleum oils, use was made of fuel oil produced from Indonesia and fuel oil produced from the Middle East and the coal dispersing oil compositions are produced by the processes A to E. Among these processes, the processes B and C are the process of the present invention.

Process A:

A petroleum oil was charged in a stainless steel beaker and a surface active agent and dry milled coal powders were added thereto and the mixture was thoroughly stirred by means of a homogenizer.

Process B:

Previously milled coal powders and a petroleum oil were mixed in a stainless steel beaker and the mixture was heated at a temperature of 140°–150° C. for 2 hours to effect dehydration and then a surface active agent was added thereto and the mixture was thoroughly stirred by means of a homogenizer.

Process C:

Coal and a petroleum oil heated at about 250° C. were charged in a wet mill provided with a heater and the coal was milled and dehydrated by heating at a temperature of 140°–150° C. for 1 hour and then the mixture was taken out in a stainless steel beaker and a surface active agent was added thereto and the mixture was thoroughly stirred by means of a homogenizer.

Process D:

Previously milled coal powders, a petroleum oil and a surface active agent were mixed in a stainless steel beaker and the mixture was heated at a temperature of 140°–150° C. to effect dehydration and then the mixture was thoroughly stirred by means of a homogenizer.

Process E:

Coal, a petroleum oil heated at about 250° C. and a surface active agent were charged in a wet mill provided with a heater and milling and dehydrating were effected at a temperature of 140°–150° C. for 1 hour and then the mixture was taken out into a stainless steel beaker and thoroughly stirred by a homogenizer.

In the processes B to E, the dehydration was effected until the water content in the composition is less than 2% by weight.

The stability of coal dispersing oil compositions produced by the above described processes were determined by the following process.

The petroleum dispersing oil composition left to stand in a thermostat at 70° C. was periodically stirred lightly with a glass bar, and the state where the stirring could be effected without resistance was judged as stable. The number of days until the stirring became "stable", was measured. The results obtained are shown in Table 1.

Table 1

| No. | (1) Coal (g) | (2) Petroleum oil (g) | Surface active agent | (g) | Production process | Stability |
|---|---|---|---|---|---|---|
| 1 | P 125 | K 100 | dodecylbenzene sulfonate | 0.2 | A | within one day |
| 2 | " | " | " | | B | more than 60 days |
| 3 | " | " | " | | C | more than 60 days |
| 4 | " | " | " | | D | within one day |
| 5 | " | " | " | | E | within one day |
| 6 | P 125 | K 100 | mono-2-ethylhexyl phosphate | 0.2 | A | within one day |
| 7 | " | " | " | | B | more than 60 days |
| 8 | " | " | " | | C | more than 60 days |
| 9 | " | " | " | | D | within one day |
| 10 | " | " | " | | E | within one day |
| 11 | P 125 | K 100 | sodium di-2-ethylhexyl sulfosuccinate | 0.2 | A | within one day |
| 12 | " | " | " | | B | more than 60 days |
| 13 | " | " | " | | C | more than 60 days |
| 14 | " | " | " | | D | within one day |
| 15 | " | " | " | | E | within one day |
| 16 | Q125 | L 100 | sodium lauryl sulfate | 0.6 | A | within one day |
| 17 | " | " | " | | B | more than 60 days |
| 18 | " | " | " | | C | more than 60 days |
| 19 | " | " | " | | D | within one day |
| 20 | " | " | " | | E | within one day |
| 21 | R 143 | L 100 | α-sulfohydrogenated tallow fatty acid | 0.6 | A | within one day |
| 22 | " | " | " | | B | more than 60 days |
| 23 | " | " | " | | C | more than 60 days |
| 24 | " | " | " | | D | within one day |
| 25 | " | " | " | | E | within one day |

Notes: (1) P: Sub-bituminous coal (water content: 20%) produced from Indonesia,
Q: Brown coal (water content: 20%) produced from Indonesia,
R: Lignite (water content 30%) produced from Japan.
(2) K: Fuel oil produced from the Middle East,
L: Fuel oil produced from Indonesia.

In Table 1 the coal dispersing oil compositions produced by process B and process C show the stability of more than 60 days, while the compositons produced by process A, process D and process E shows stability of less than one day.

What is claimed is:

1. A method for producing coal dispersing oil compositions containing 10–89.99% by weight of a petroleum oil, 10–89.99% by weight of coal powders and 0.01 to 5% by weight of a surface active agent wherein previously milled coal powders and a petroleum oil are mixed and then dehydrated, or a coal is milled and dehydrated in the petroleum oil, after which a surface active agent is added thereto to obtain dispersion.

2. The method as claimed in claim 1, wherein the coal powders are powders of sub-bituminous coal, brown coal, or lignite.

3. The method as claimed in claim 1, wherein the petroleum is fuel oil.

4. The method as claimed in claim 1, wherein the surface active agent is at least one of the group consisting of alkyl phosphates, alkylphenyl phosphates, polyoxyalkylene alkyl ether phosphates, polyoxyalkylene alkylphenyl ether phosphates, dialkyl sulfosuccinates, dialkenyl sulfosuccinates, alkane sulfonic acids, α-sulfonated fatty acids, α-sulfonated fatty acid alkyl esters, alkylbenzene sulfonic acids, alkylphenyl sulfonic acids, naphthalene sulfonic acids, petroleum sulfonic acids, alkyl sulfates, polyoxyalkylene alkyl ether sulfates, polyoxyalkylene alkylphenyl ether sulfates, polyoxyalkylene fatty acid ester sulfates, sulfated fatty acids, and metal salts and amine salts of these compounds.

* * * * *